US005277559A

United States Patent [19]

Schultz

[11] Patent Number: 5,277,559

[45] Date of Patent: Jan. 11, 1994

[54] SLIDING SEAL PUMP

[75] Inventor: Robert Schultz, Old Greenwich, Conn.

[73] Assignee: Emson Research, Inc., Bridgeport, Conn.

[21] Appl. No.: 981,694

[22] Filed: Nov. 25, 1992

[51] Int. Cl.[5] ..... F04B 11/00

[52] U.S. Cl. ..... 417/543; 417/545

[58] Field of Search ..... 417/540, 541, 542, 543; 137/533.27, 543.15; 222/321, 383, 385

[56] References Cited

U.S. PATENT DOCUMENTS

| | | | |
|---|---|---|---|
| 3,331,559 | 7/1967 | Fedit . | |
| 3,669,151 | 6/1972 | Fleming | 417/543 |
| 4,144,987 | 3/1979 | Kishi | 222/321 |
| 4,389,003 | 6/1983 | Meshberg | 222/321 |
| 4,986,453 | 1/1991 | Lina et al. | 222/321 |
| 5,096,097 | 3/1992 | Lina | 222/321 |

FOREIGN PATENT DOCUMENTS 0342651 4/1991 Fed. Rep. of Germany .

*Primary Examiner*—Richard A. Bertsch
*Assistant Examiner*—Alfred Basichas
*Attorney, Agent, or Firm*—Kenyon & Kenyon

[57] ABSTRACT

A precompression pump is disclosed with a sliding inlet valve seal. In a first embodiment, the valve seal has sealing and retention surfaces which interact with sealing and retention surfaces on a bead on the inner wall of the pump chamber, to seal the pump inlet and retain the inlet seal respectively. In a second embodiment, the seal has friction tabs which engage the outer wall of the pump chamber. On the upstroke of the piston, these tabs engage a bead on the inner wall of the pump chamber, causing the tabs to rotate about a hinge, increasing the outer diameter of the seal. The result is improved frictional engagement of the seal with the inner wall, resulting in improved retention of the seal.

5 Claims, 10 Drawing Sheets

SLIDING SEAL PUMP

BACKGROUND OF THE INVENTION

The present invention is directed to an atomizing pump using a sliding inlet valve seal, and more particularly a precompression pump which utilizes a sliding inlet valve seal.

Dispensing pumps have been described which use a sliding inlet valve seal. U.S. Pat. No. 3,331,559 to Fedit describes a liquid atomizer which includes a valve rod 12 upon which is mounted a seal ring 17. A retaining ring 15 retains the seal ring 17 within an annular cavity 16. Axially-inward movement of the valve rod 12 causes the seal ring 17 to seat against a seating surface $\mathbf{13}_1$, sealing off the pump chamber from the inlet. Axially-outward movement of the rod 12 causes the seal ring 17 to unseat from the surface $\mathbf{13}_1$, allowing the flow of liquid into the pump chamber. Axially-outward movement of the seal ring 17 is constrained by the retaining ring 15.

Sliding inlet valve seals have been used in precompression pumps, i.e., pumps in which opening of the outlet valve is controlled by the pressure within the pump chamber. Precompression pumps using a sliding inlet seal are shown in U.S. Pat. Nos. 4,144,987 to Kishi and 4,389,003 to Meshberg. A precompression pump with a movable seal member is disclosed in European Patent Specification No. 0 342 651.

SUMMARY OF THE INVENTION

The present invention is directed to a precompression dispensing pump which uses a sliding inlet valve seal. In one embodiment of the present invention, a circumferential bead on the inner wall of the pump cylinder is used to both retain the inlet seal and provide a sealing surface for the inlet seal to engage. In another embodiment, friction tabs are used to enhance the engagement between the cylinder walls and the sliding seal, thus preventing the sliding seal from "jumping" the retaining bead.

DETAILED DESCRIPTION

Figure 1:
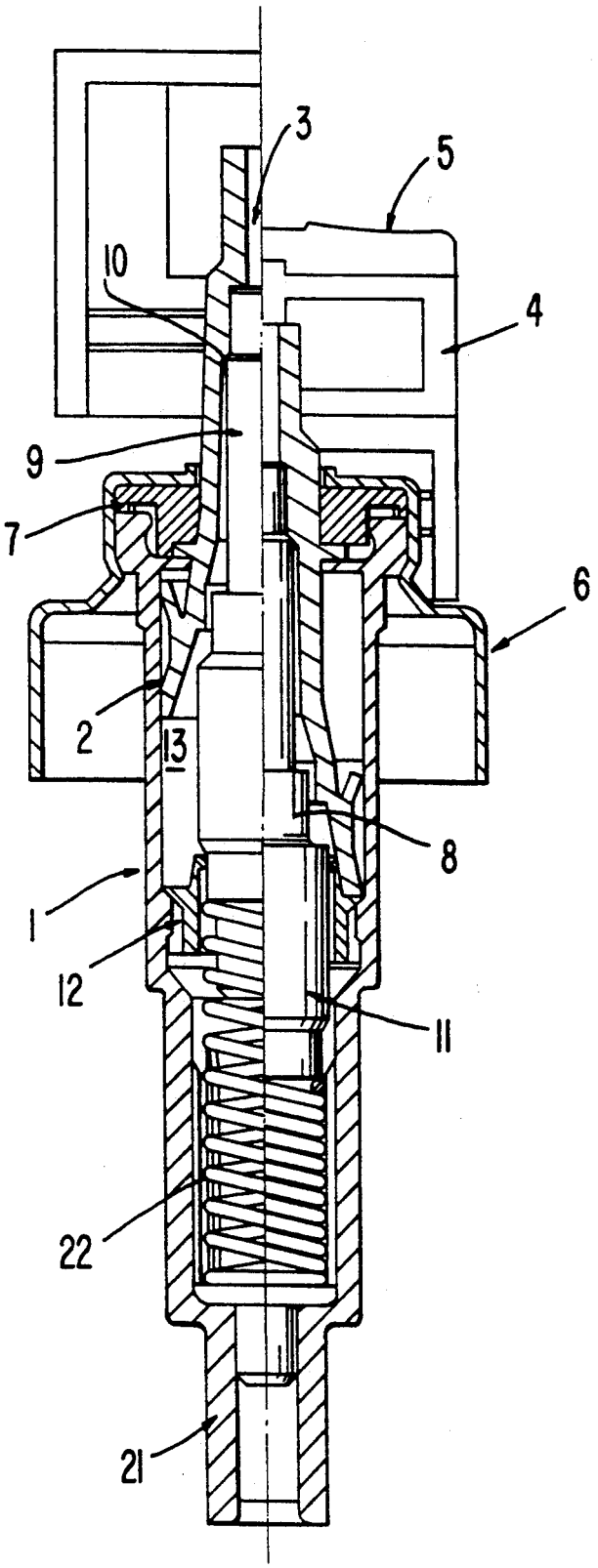
FIG. 1 shows an assembly view of a first embodiment of the present invention, with the left-hand side of the centerline of the drawing representing the pump in its unactuated position, and the right-hand side of the centerline of the drawing representing the pump in its actuated position.

FIG. 1 shows a first embodiment of the pump of the present invention. The pump includes a cylinder 1, in which a piston 2 slides. Piston 2 includes an outlet passage 3 which leads to the atomizing nozzle 4. Atomizing nozzle 4 is housed on an actuator assembly 5. The cylinder 1 can be mounted on a container or bottle (not shown) by means of a mounting cap 6, which can include a suitable sealing device 7.

Contained within the cylinder 1 is a valve stem 8. Valve stem includes an upper end 9 which seats against a valve seat surface 10 on the piston 2, and a lower portion 11. A spring 22 biases the stem 8 axially-outward into engagement with the valve seat 10. The valve stem 8 is constructed such that there is an axially-outward facing net surface area within the pump chamber after the inlet valve is closed, thereby allowing the outlet valve 9, 10 to open only when sufficient pressure is generated within the pump chamber. This "precompression" operation is shown and described in the pumps of U.S. Pat. Nos. 4,144,987 and 4,389,003.

Figure 2:
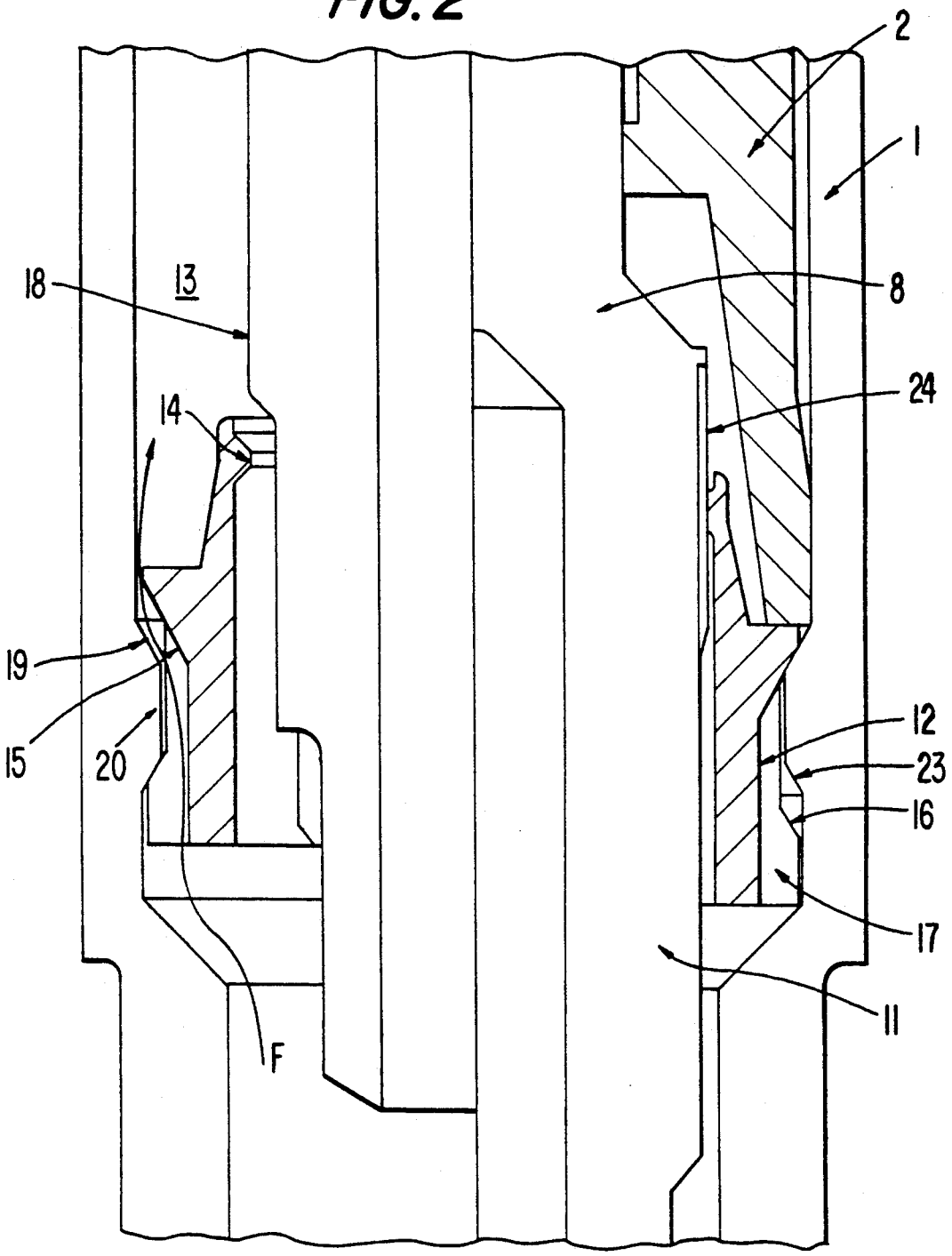
FIG. 2 shows a detail view of the inlet seal of the embodiment of FIG. 1, with the left-hand side of the centerline of the drawing representing the pump in its unactuated position, and the right-hand side of the centerline of the drawing representing the pump in its actuated position.

The specific structure and operation of the inlet valve seal of the embodiment of FIG. 1 will now be described with reference to FIG. 2, which shows the inlet valve seal in detail. In FIG. 2, the spring 22 is not shown for ease of reference; normally a spring would be included in this pump. An inlet seal 12 is mounted near the bottom of the pump chamber 13. The inlet seal 12 includes an inner lip 14 designed to engage the outer surface of the valve stem 8 (as shown on the right-hand side of the centerline of FIG. 2). Inlet seal 12 also includes a axially-inward facing sealing surface 15, and an axially-outward facing retention surface 16. Inlet seal further includes circumferentially-spaced flow passages 17.

Operation of the pump will be described with reference to FIGS. 1 and 2. Axially-inward depression of actuator 5 will move piston 2 axially inward in pump chamber 1. Axially-inward movement of piston 2 causes axially-inward movement of valve stem 8, which is engaged with piston 2 at the valve surface 10. As shown in FIG. 2, axially-inward movement of stem 8 will cause the inner lip 14 to engage an outer surface 18 of the valve stem 8. The engagement between the outer surface 18 and the inner lip 14 is a frictional fit. The friction fit between the outer surface 18 and the inner lip 14 is such that further axially-inward movement of the valve stem 8 will cause axially-inward movement of the inlet seal 12. Upon axially-inward movement of the inlet seal 12, the axially-inward facing sealing surface 15 will engage an axially-outward facing sealing surface 19 on a bead 20 on the inner wall of the pump cylinder 1. The engagement between the inner lip 14 and the stem 8 and the engagement between sealing surfaces 15, 19 acts to seal off the pump chamber 13 from the inlet passage 20 to the pump. Further axially-inward force on the piston 2 will cause the pressure in the pump chamber 13 to increase, until this pressure is sufficient to overcome the spring 22 force and open the outlet valve 9, 10. The manner in which the outlet valve is opened in response to pressure in the pump chamber is described in U.S. Pat. Nos. 4,144,987 and 4,389,003, the disclosures of these patents being incorporated herein by reference.

Upon release of any actuating force on the actuator 5, the spring 22 acts to push the stem 8 axially-outward, closing the outlet valve and pushing the piston 2 axially-outward. Axially-outward movement of the stem 8 pulls the inlet seal 12 axially-outward, disengaging the sealing surfaces 15, 19. Disengagement of the sealing surfaces 15, 19 allows liquid to flow through flow passages 17 into the pump chamber 13—the liquid being drawn into the pump chamber 13 by the increase in volume of the pump chamber 13 resulting from axially-outward movement of the piston 2. The flow of liquid into the pump chamber is indicated in FIG. 2 by arrow F. Continued axially-outward movement of the inlet seal 12 is restrained by engagement of the axially-outward facing retention surface 16 on the inlet seal 12 with the axially-inward facing retention surface 23 on the bead 20. Axially outward movement of the stem 8 continues until the piston 2 reaches the top of its stroke, represented in FIG. 2 by the left-hand side of the centerline. In this position, further flow of liquid is allowed between the inner lip 14 and the lower portion 11 of stem 8.

FIG. 2 also shows an air-venting mechanism 24 on the stem 8, used to exhaust air trapped in the pump chamber 13. The air-venting mechanism 24 operates in the same manner as the mechanism described in U.S. Pat. No. 4,144,987, the disclosure of the mechanism described in that patent being incorporated herein by reference.

Figure 4A:
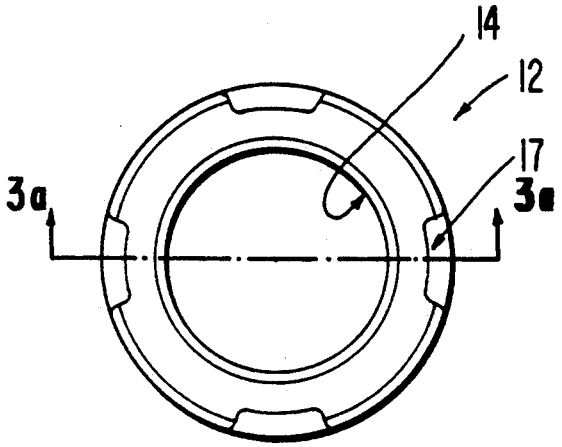
FIGS. 3*a* and 4*a* respectively show bottom and section views of the seal shown in FIGS. 1 and 2.
Figure 3A:
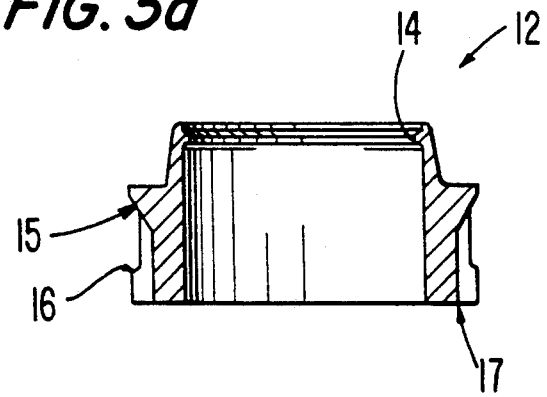
Figure 4B:
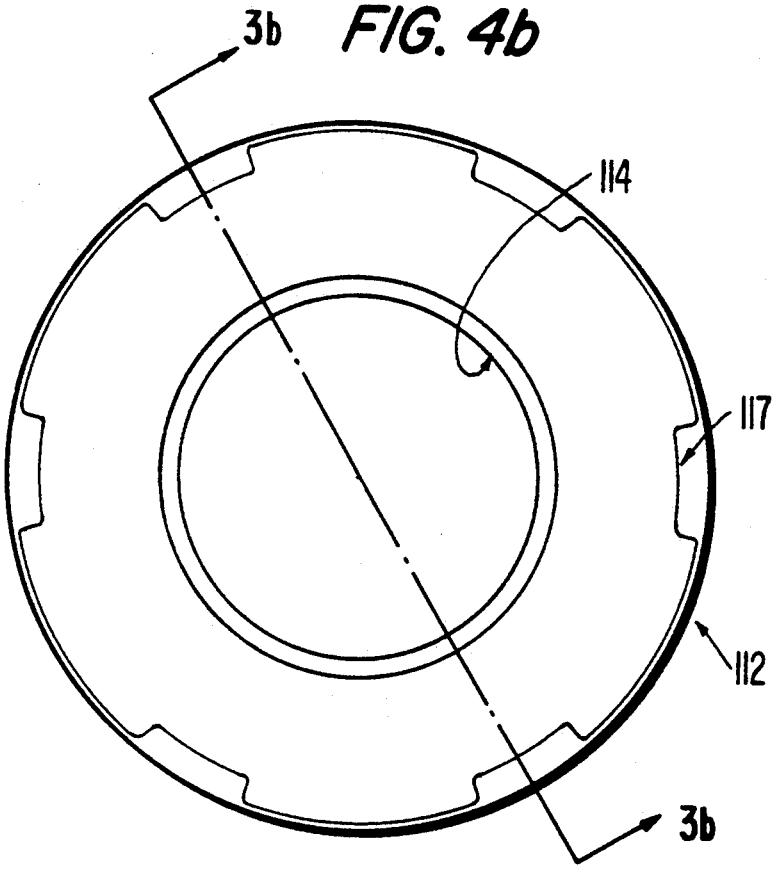
FIGS. 3*b* and 4*b* respectively show bottom and section views of a second embodiment of the seal of FIGS. 1 and 2.
Figure 3B:
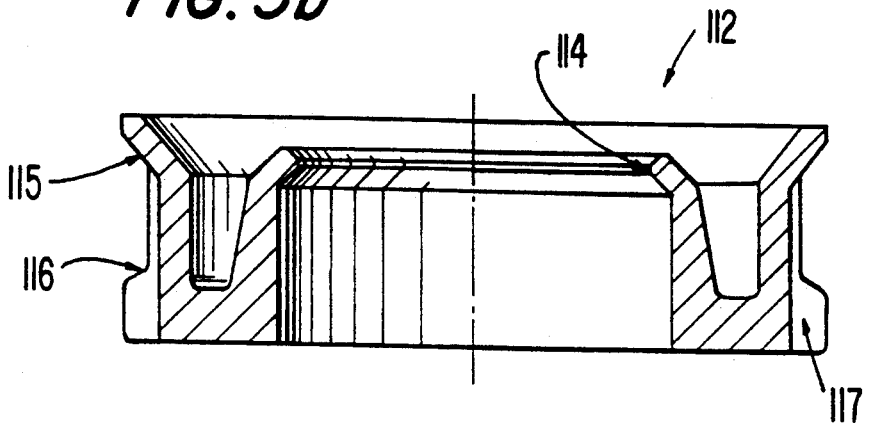

FIGS. 3*b* and 4*b* show a second embodiment of the inlet seal of the type in FIGS. 3*a* and 3*b*, the inlet seal being designated by the reference numeral 112. This inlet seal is configured slightly different than the inlet seal 12 of FIGS. 3*a* and 4*a*; however, the seal operates in the same manner described above. FIGS. 3*b* and 4*b* show the configuration of the inner lip 114, flow passages 117, and axially-outward and axially-inward facing surfaces 116 and 115.

Figure 5:
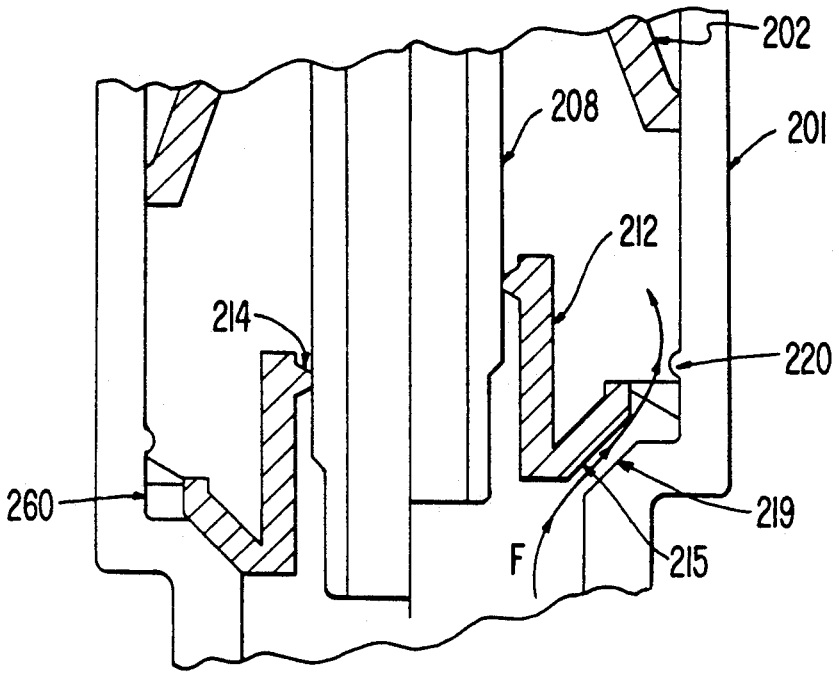
FIG. 5 shows a detail view of a second embodiment of the present invention, with the left-hand side of the centerline of the drawing representing the pump in its actuated position, and the right-hand side of the centerline of the drawing representing the pump in its unactuated position.
Figure 7:
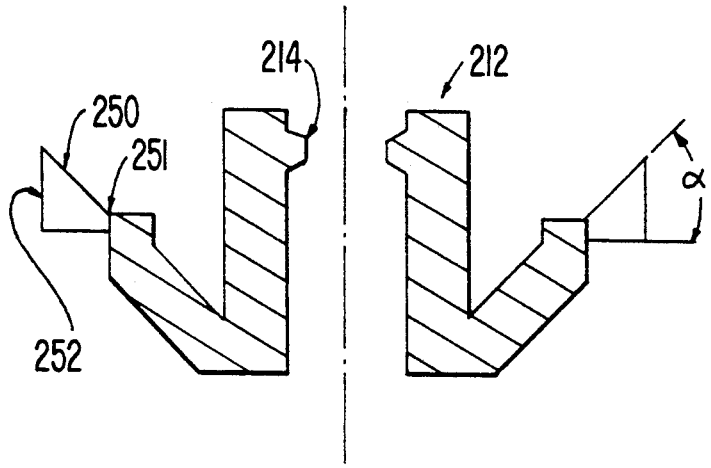
FIGS. 6 and 7 respectively show bottom and section views of the seal shown in FIG. 5.
Figure 6:
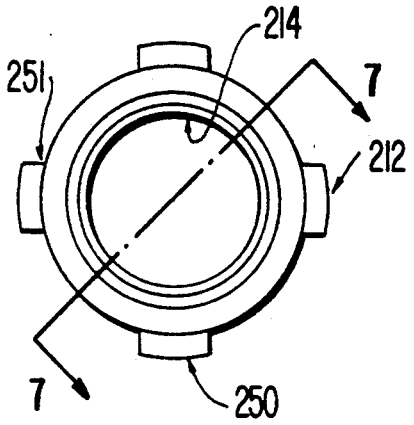

FIG. 5 shows a detail view of a second embodiment of the present invention. The operation of the piston, stem, cylinder and spring in the embodiment of FIGS. 5–7 is identical to the operation described above in relation to FIGS. 1 and 2. In the embodiment of FIG. 5, the axially-inward facing sealing surface 215 on the seal 212 engages an axially-outward facing sealing surface 219 at the bottom of the pump chamber 213. The outer periphery of the seal 212 includes circumferentially-spaced friction tabs 250. Friction tabs 250 are connected to the seal 212 by a narrowed resilient hinge section 251. Friction tabs 250 include a flattened outer portion 252, and are tapered from outer portion 252 to the point of hinge section 251. Preferably, the taper is at an angle $\alpha$ of between 20° and 30°.

In operation, axially-inward movement of stem 208 moves the seal 212 axially-inward until axially-inward facing surface 215 engages axially-outward facing surface 219, thereby sealing off the pump chamber 213 from the pump chamber inlet. During axially-inward movement of the seal 212, the outer portion 252 is flattened against the wall 260 of the pump chamber, providing minimal frictional resistance to movement. Axially-outward movement of stem 208 causes the surfaces 215 and 219 to disengage, allowing liquid to flow into the pump chamber, as indicated by arrow F. During initial axially-outward movement of the seal 212, the outer portion 252 is flattened against the wall 260, providing minimal frictional resistance to movement. However, axially-outward movement of seal 212 will cause the tabs 250 to engage the bead 220. Further axially-outward movement of the seal 212 will cause the tabs 250 to rotate around hinge 251, increasing the effective outer diameter of the seal (as shown in the right-hand side of the centerline in FIG. 5). This increase in diameter will wedge the seal against the wall 260, increasing the frictional force between the seal 212 and the wall 260. This increased frictional force will prevent the seal 212 from further axially-outward movement, and ensures that the seal 212 will not "jump" (i.e., travel above the level of) the bead 220. This feature ensures reliable and effective operation of the seal 212. Upon axially-inward movement of stem 208, the tab 250 will again rotate around hinge 251, to the position shown on the left-hand side of the centerline in FIG. 5.

Figure 8:
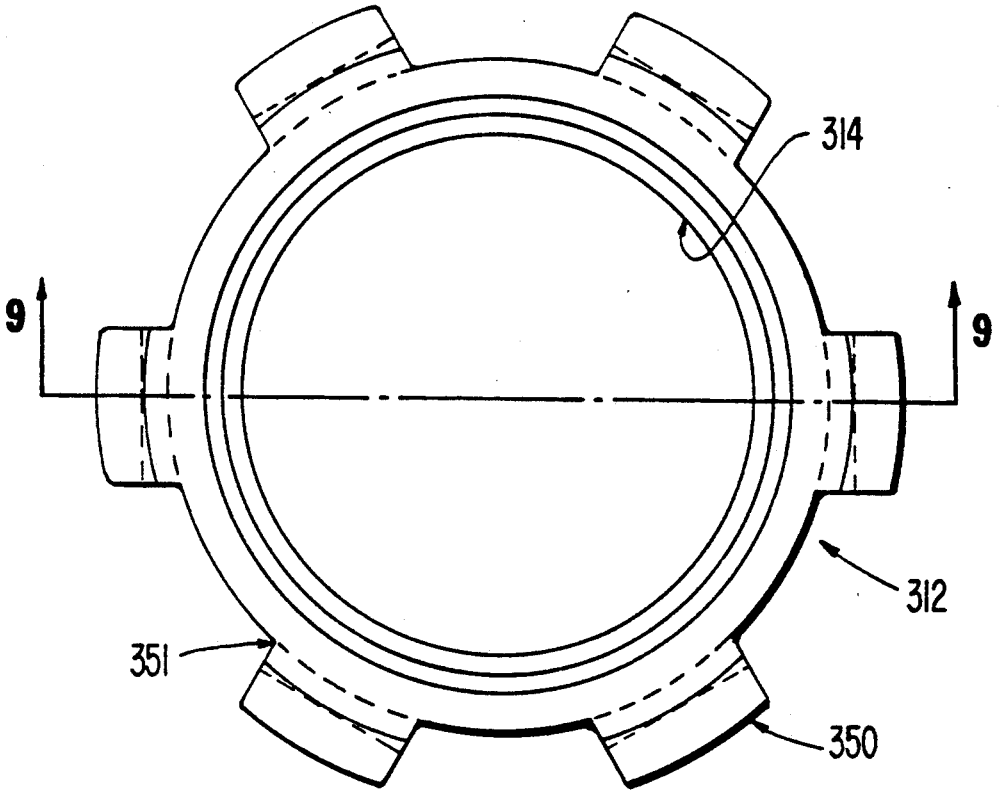
FIGS. 8 and 9 respectively show top and section views of a second embodiment of the seal of FIG. 5.
Figure 9:
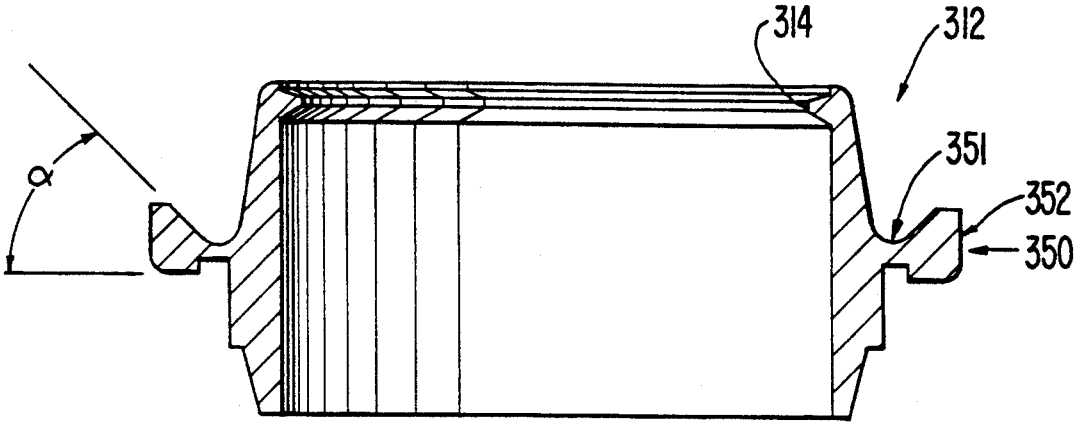

FIGS. 8 and 9 show a second embodiment of the inlet seal of the type shown in FIGS. 5–7, the inlet seal being designated by the reference numeral 312. This inlet seal is configured slightly different than the inlet seal 212 of FIGS. 5–7; however, the seal operates in the same manner described above. FIGS. 8 and 9 show the configuration of the inner lip 314, hinge 351, tabs 350 and outer surface 352.

Figure 10:
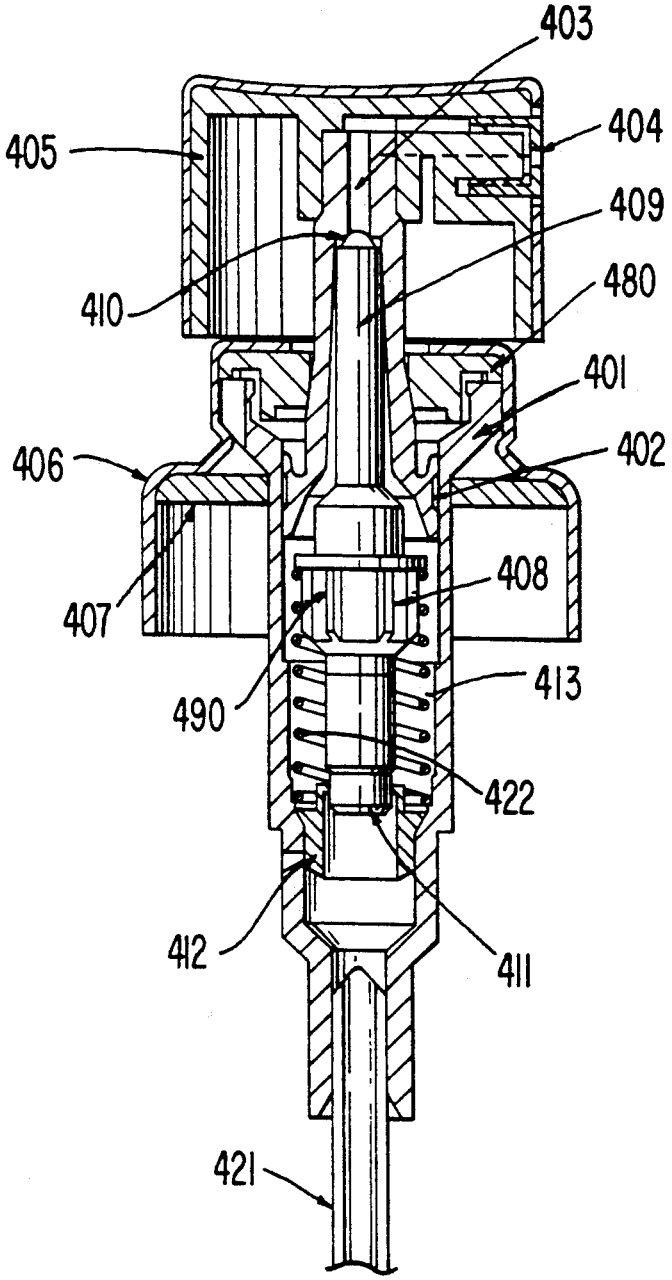
FIG. 10 shows an assembly view of a third embodiment of the present invention.
Figure 11:
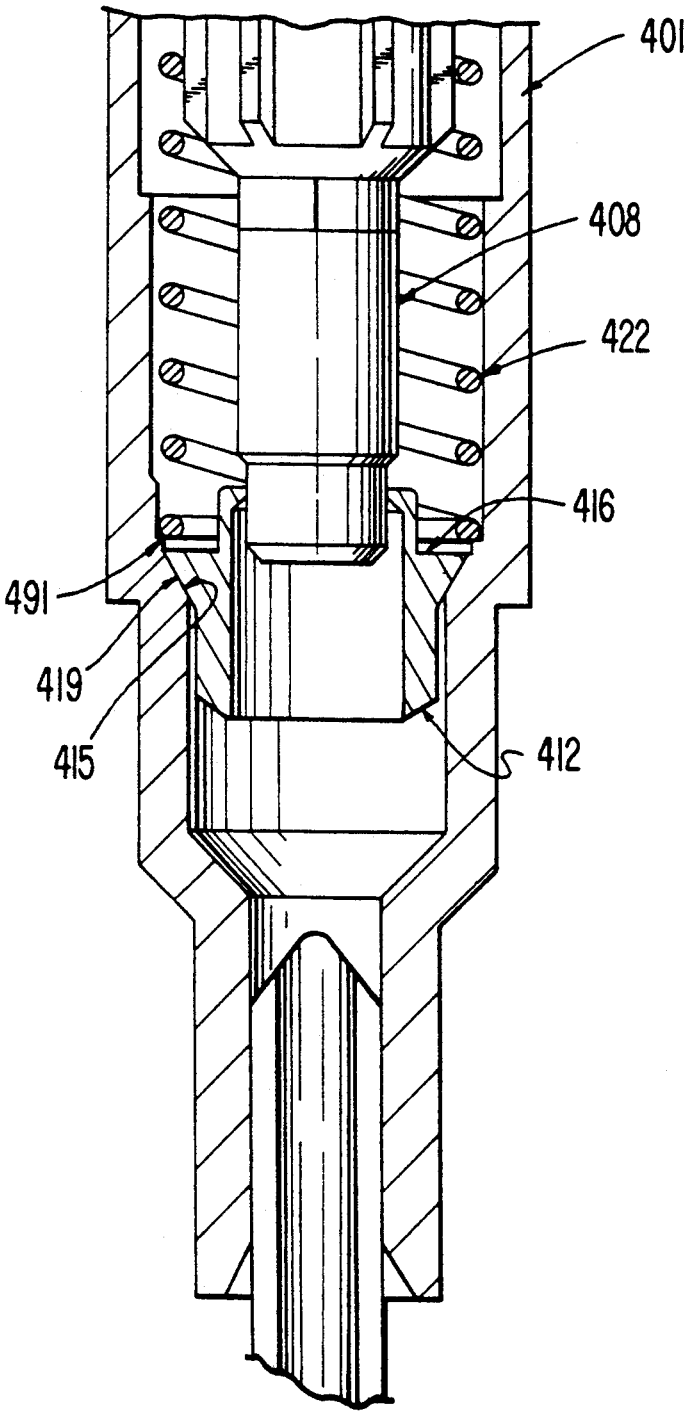
FIG. 11 shows a detail view of the inlet seal of the embodiment of FIG. 10.

FIGS. 10–11 show a third embodiment of the present invention. The operation of the piston, stem, cylinder and spring in the embodiment of FIGS. 10–11 is identical to the operation described above in relation to FIGS. 1 and 2. However, in the embodiment of FIGS. 10–11, the lower portion of the spring 422 acts to retain the seal 412 in the bottom of the pump chamber. As can be seen in FIG. 11, the spring 422 is mounted within the pump chamber 413, interposed between a retaining mechanism 490 on the valve stem 408 and a ridge 491 near the bottom of the pump chamber 413. The spring 422 lower end protrudes radially inward from the edge of the ridge 491. This protruding portion of the spring acts as an axially-inward facing surface which interacts with the axially-outward facing surface 416 of the seal 412 to restrain axially-outward movement of the seal 412, in the manner of the surface 23 in the embodiment of FIGS. 1 and 2. On the upstroke of the piston, the liquid flows between the sealing surface 415 of the seal 412 and the sealing surface 419 of the cylinder 401, which become spaced from each other during the upstroke. Liquid is able to pass into the pump chamber 413 at those portions where the spring 422 does not contact the surface 416, the lower end of the spring 422 not forming a complete circle at the point at which it contacts ridge 491.

Figure 12:
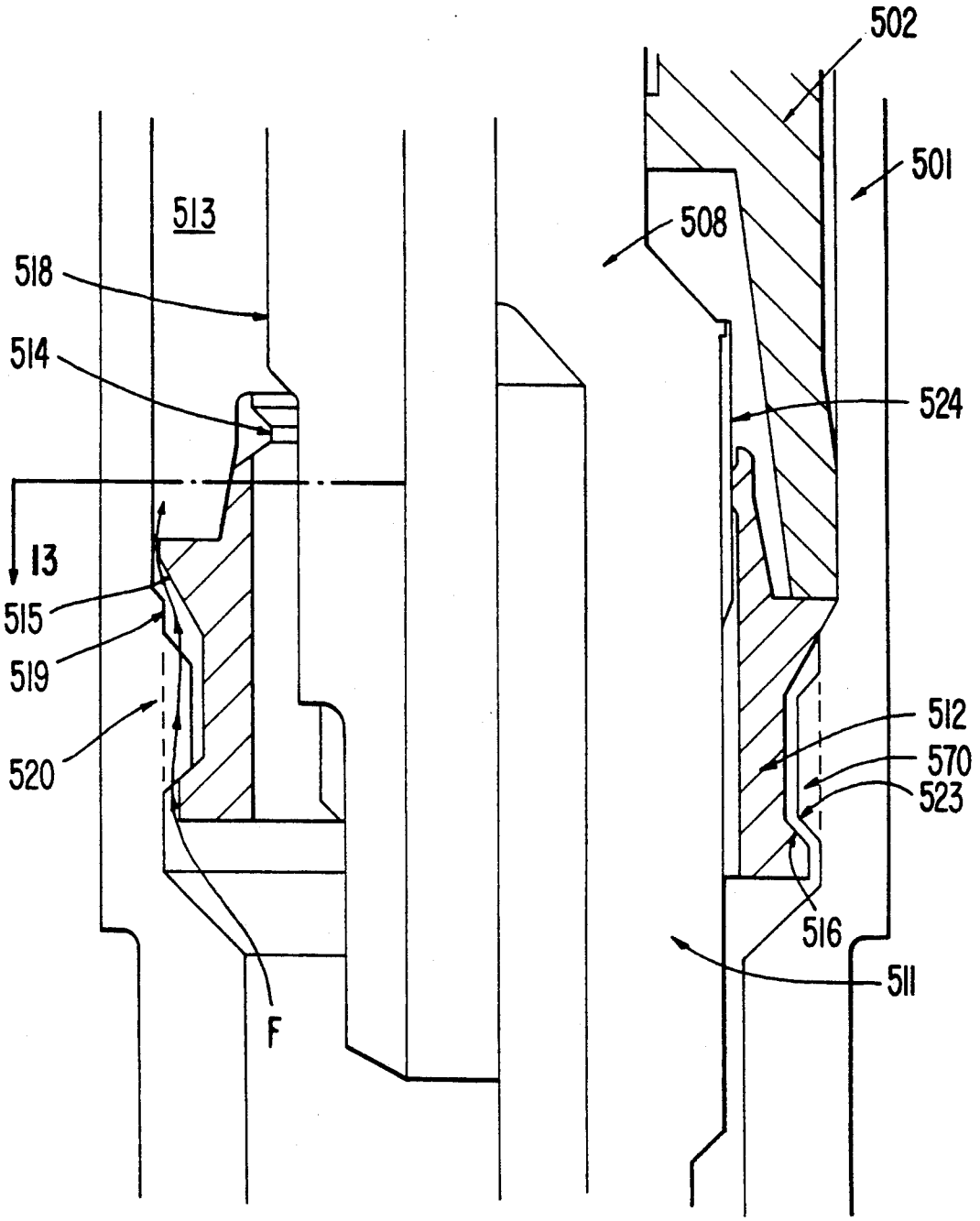
FIG. 12 shows a detail view of the inlet seal of a fourth embodiment of the present invention.
Figure 13:
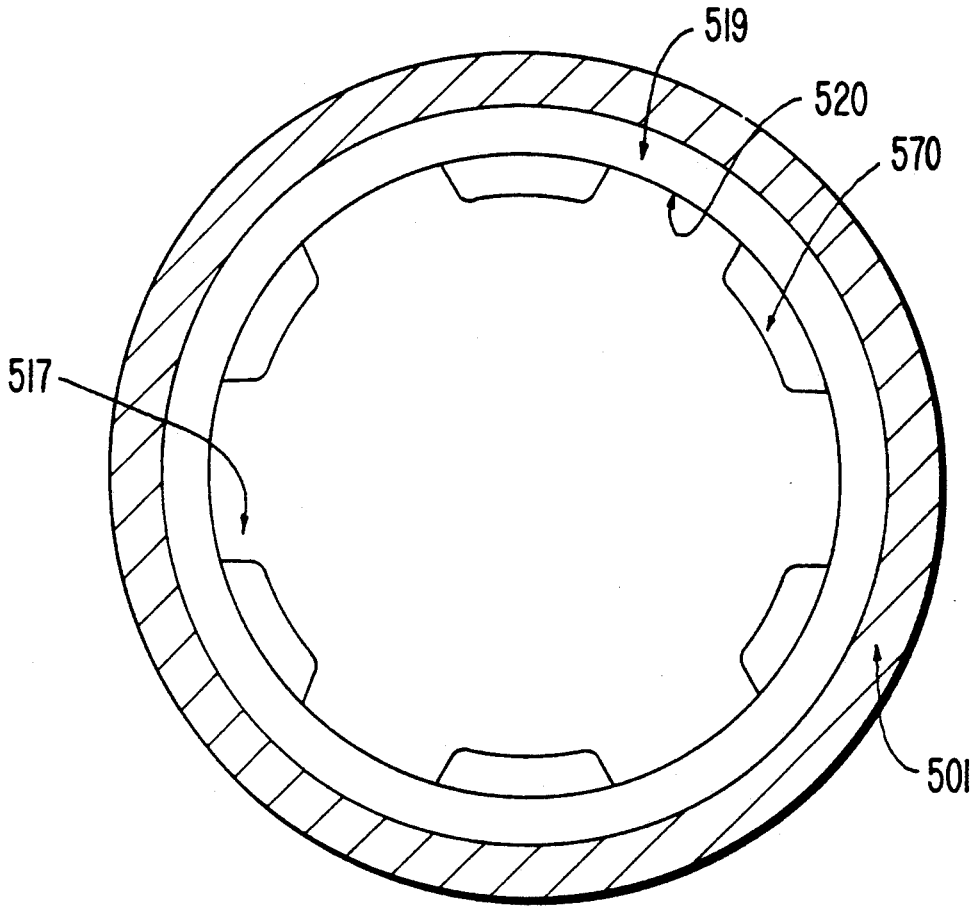
FIG. 13 shows a cross-sectional view of the pump cylinder of the embodiment of FIG. 12.

FIGS. 12–13 show a fourth embodiment of the present invention. The operation of the piston, stem, cylinder and spring in the embodiment of FIGS. 12–13 is identical to the operation described above in relation to FIGS. 1 and 2. In the embodiment of FIGS. 12–13, however, the flow passages 517 do not pass through slots in the seal 512, but instead pass between projections 570 on the annular bead 520. FIG. 13 shows a cross-sectional view of the cylinder wall 501, showing the continuous annular bead 520 extending around the circumference of the inner wall of the cylinder 501, and the radially-spaced projections 570 which extend from this bead 520. Fluid flows, during upstroke of the pump, in the spaces between the projections 570. The flow path is designated by the arrow F in FIG. 12. In all other respects, the seal operates in the manner shown and described in relation to FIGS. 1 and 2.

I claim:

1. A dispensing pump comprising:

a pump cylinder, said pump cylinder comprising a retention surface, an inner wall and a bead disposed on said inner wall, said bead comprising an axially outward facing sealing surface;

a pump inlet in fluid communication with said pump cylinder;

a pump piston reciprocally mounted in said cylinder, said pump piston comprising an outlet valve seat;

a valve stem reciprocally mounted in said cylinder, said valve stem comprising an outlet valve member engageable with said outlet valve seat and a radially outer surface;

an inlet seal reciprocally mounted in said cylinder, said inlet seal, pump cylinder, pump piston and valve stem defining a pump chamber, said inlet seal comprising:

a radially inner surface engageable with the radially outer surface of said valve stem;

an axially inward facing sealing surface engageable with the axially outward facing sealing surface of said bead, wherein engagement between said axially inward facing sealing surface and said axially outward facing sealing surface of said bead interrupts fluid communication between said pump chamber and said pump inlet, and wherein disengagement between said axially inward facing sealing surface and said axially outward facing sealing surface of said bead allows fluid communication between said pump chamber and said pump inlet; and an axially outward facing retention surface engageable with the axially inward facing retention surface of said bead, wherein engagement between said axially inward retention sealing surface and said axially outward facing retention surface of said bead prevents axially outward movement of said inlet seal.

2. The dispensing pump of claim 1, wherein:

said fluid communication between said pump chamber and said pump inlet is through at least one flow passage in said inlet seal.

3. The dispensing pump of claim 2, wherein:

there are a plurality of flow passages in said inlet seal.

4. The dispensing pump of claim 1, wherein:

said fluid communication between said pump chamber and said pump inlet is through at least one flow passage in said bead.

5. The dispensing pump of claim 4, wherein:

there are a plurality of flow passages in said bead.

* * * * *